US011380472B2

(12) United States Patent
Pietambaram et al.

(10) Patent No.: US 11,380,472 B2
(45) Date of Patent: Jul. 5, 2022

(54) HIGH-PERMEABILITY MAGNETIC-DIELECTRIC FILM-BASED INDUCTORS

(71) Applicant: Intel Corporation, Santa Clara, CA (US)

(72) Inventors: Srinivas V. Pietambaram, Gilbert, AZ (US); Kristof Darmawikarta, Chandler, AZ (US); Rahul N. Manepalli, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 809 days.

(21) Appl. No.: 16/141,168

(22) Filed: Sep. 25, 2018

(65) Prior Publication Data

US 2020/0098503 A1 Mar. 26, 2020

(51) Int. Cl.

| | |
|---|---|
| ***H01F 5/00*** | (2006.01) |
| ***H01F 27/24*** | (2006.01) |
| ***H01F 27/28*** | (2006.01) |
| ***H01F 27/29*** | (2006.01) |
| ***H01F 41/14*** | (2006.01) |
| ***H01F 27/40*** | (2006.01) |
| ***H01F 27/32*** | (2006.01) |

(52) U.S. Cl.

CPC ..... *H01F 27/24* (2013.01); *H01F 27/2804* (2013.01); *H01F 27/29* (2013.01); *H01F 27/323* (2013.01); *H01F 27/40* (2013.01); *H01F 41/14* (2013.01)

(58) Field of Classification Search

CPC ..... H01F 2017/002; H01F 2017/0066; H01F 27/323; H01F 41/14

USPC ..... 336/84, 200

See application file for complete search history.

(56) References Cited

U.S. PATENT DOCUMENTS

2001/0055819 A1* 12/2001 Webster ..... H01L 23/645 438/3

2006/0186495 A1* 8/2006 Rizzo ..... H01L 43/12 257/421

(Continued)

OTHER PUBLICATIONS

Pietambaram, Srinivas V, et al., "Low-power switching in magnetoresistive random access memory bits using enhanced permeability dielectric films", Appl. Phys. Lett. 90, 143510 (2007); doi: 10.1063/1.2719671, (2007), 4 pgs.

*Primary Examiner* — Ronald Hinson

(74) *Attorney, Agent, or Firm* — Schwegman Lundberg & Woessner, P.A.

(57) ABSTRACT

Various embodiments include, for example, a magnetic-dielectric film-based inductor that can be embedded in an electronic package for use as an integrated voltage-regulator, multiple conductive regions to provide electrical interconnects to the magnetic-dielectric-based inductor from other devices, multiple conductive pillars that are electrically coupled to and formed over at least some of the conductive regions, and a magnetic-dielectric layer formed over at least some of conductive regions and conductive pillars. The magnetic-dielectric layer is formed by a multi-layer formation technique having multiple dielectric-material layers and multiple magnetic-material layers. Each of the magnetic-material layers is interspersed with at least one of the dielectric-material layers. Other devices, apparatuses, and methods are described.

23 Claims, 9 Drawing Sheets

(56) References Cited

U.S. PATENT DOCUMENTS

| | | | | |
|---|---|---|---|---|
| 2015/0077209 | A1* | 3/2015 | Fujii | H01F 17/0006 336/200 |
| 2015/0340338 | A1* | 11/2015 | Lee | H01F 17/0033 257/531 |
| 2018/0005740 | A1* | 1/2018 | Doris | H01F 3/10 |

* cited by examiner

HIGH-PERMEABILITY MAGNETIC-DIELECTRIC FILM-BASED INDUCTORS

TECHNICAL FIELD

Embodiments described herein relate generally to microelectronic devices having one or more embedded components on a substrate. More specifically, the disclosed subject matter relates to electronic packages including embedded magnetic inductors.

BACKGROUND

Inductors are frequently-used components in substrate packaging in the semiconductor and allied industries. Inductors are necessary to form, for example, a functional integrated voltage-regulator. In contemporaneous electronic packaging, inductors can take various forms. For example, discrete inductors can be embedded in a substrate or surface mounted on a substrate. Integrated air-core inductors (ACI) are fabricated typically on the backside of a substrate in tandem with other layers on the substrate. However, each of these two generic methods have drawbacks. Discrete inductors can be costly, embedding process can be complicated, and surface mounting can add undesired thickness to an overall z-height of the substrate. Integrated ACIs, while less costly, do not provide as high of inductance as discrete inductors and consequently take up valuable real estate on a substrate in order to meet target inductance values.

One proposed solution uses magnetic fillers embedded in an organic dielectric-epoxy-laminate film to increase the magnetic permeability of the film, thereby enhancing the performance of ACI or integrated coil inductors. However, this exotic class of film provides a limited improvement in magnetic permeability. Also, these films, as recently demonstrated, do not conform well with industry standard flows: (i) laser drilling of vias in this film has proven to be difficult; and (ii) there is a risk of contamination in subsequent wet plating and etch tools, such as de-smear, electroless-copper seed, seed etching, and copper-roughening baths. As a result, the magnetic film formulation must be tailored, running the risk of over-engineering the film to suit the standard process flow. This tailoring may pose a further restriction to the magnetic property of the film. For example, a class of magnetic fillers with a much lower magnetic permeability may be needed to ensure no dissolution of the filler materials in subsequent plating chemistries. Several disclosures to limit the exposure of these laminated films to substrate wet processes have recently been proposed. However, magnetic permeabilities that can be achieved by these proposed laminate films is limited. The need to make these films compatible with substrate manufacturing further reduces the permeability that can be achieved with these films.

It is therefore desirable to have magnetic films that have a much higher permeability than is currently available (e.g., as is used with laminate films). Processes used while forming these magnetic films should also isolate the magnetic films from sensitive baths in wet process tools in order to preserve fully their magnetic properties.

The information described in this section is provided to offer the skilled artisan a context for the following disclosed subject matter and should not be considered as admitted prior art.

BRIEF DESCRIPTION OF THE DRAWINGS

In the drawings, which are not necessarily drawn to scale, like numerals describe substantially-similar components throughout the several views. Like numerals having different letter suffixes represent different instances of substantially-similar components. The drawings illustrate generally, by way of example, but not by way of limitation, various embodiments discussed in the present document.

FIGS. 1A-1L show various cross-sectional views of an exemplary process flow to create embedded inductors in coreless-substrate fabrication according to various embodiments of the disclosed subject matter;

DETAILED DESCRIPTION

Figure 1A:
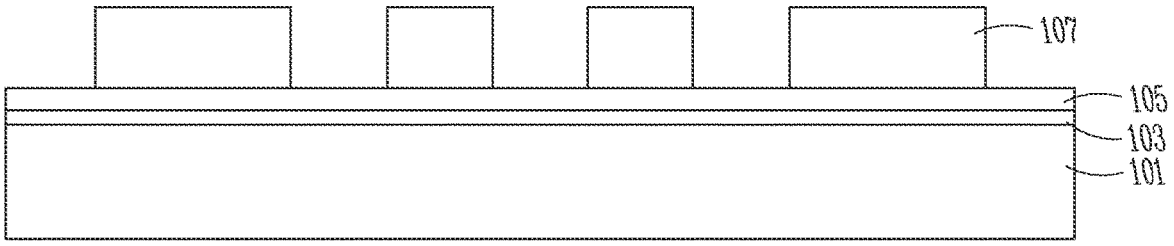

Reference will now be made in detail to certain embodiments of the disclosed subject matter, examples of which are illustrated in part in the accompanying drawings. Other embodiments may incorporate structural, logical, electrical, process, and other changes. Portions and features of some embodiments may be included in, or substituted for, those of other embodiments. While the disclosed subject matter will be described in conjunction with the enumerated claims, it will be understood that the exemplified subject matter is not intended to limit the claims to the disclosed subject matter.

In various embodiments described herein, the disclosed subject matter uses magnetic-dielectric films (e.g., a number of magnetic-material layers that are each interspersed with a thin dielectric layer) that are seamlessly integrated into other processes with little or no exposure to wet chemistries in a manufacturing process. The magnetic-dielectric films exhibit high permeabilities. In one specific exemplary embodiment, the magnetic dielectric-films are formed onto other layers by sputtering techniques, known to a skilled artisan. The magnetic-dielectric films can be adapted to both coreless-substrate and cored-substrate architectures. However, the detailed description provided herein focuses on process flows using coreless-substrate architectures, which provides a benefit over cored-substrate architectures since coreless-substrates offer a beneficial lower z-height afforded by integrated magnetic-film inductors. Upon reading and understanding the disclosure provided herein, the person of ordinary skill in the art will readily understand how to apply the disclosed subject matter to cored-substrate architectures as well.

In a specific exemplary embodiment, the disclosed subject matter relates to high-permeability magnetic-dielectric films for enhanced induction in package-integrated voltage regulators. However, the disclosed subject matter is not limited to use of the so-formed inductors in voltage regulators. Upon reading and understanding the disclosure provided herein, a person of ordinary skill in the art will recognize a wide variety of applications involving a high-permeability magnetic-dielectric film and resulting enhanced-induction devices and techniques for forming the enhanced-induction devices as disclosed herein.

In various embodiments, the disclosed subject matter uses magnetic-dielectric films formed during processes that are described in detail, below. The magnetic-dielectric films have high permeabilities (e.g., greater than 5) as compared with, for example, contemporaneous magnetic fillers embedded in an organic, dielectric-epoxy-laminate film. These film types can only achieve a maximum permeability of about 5.

In various embodiments, the magnetic-dielectric films are sputtered around the inductor features followed by a lithography-defined via process (litho-defined via). The litho-defined via process involves plating of vias that are litho defined on desired pads, laminating build-up dielectric, and a grinding/planarizing step to expose the via. A seed layer is subsequently deposited (e.g., sputtered), followed by a traditional semi-additive process (SAP), thus ensuring little exposure, or no exposure, of the magnetic-dielectric films to wet chemistries as are frequently used in various substrate manufacturing processes.

In various embodiments, and as described in more detail below, a process flow to create the proposed inductors may be used with a coreless architecture. Inductor features and pads for via connections are first formed on a peel-able core carrier (substrate). Via connections for the subsequent layer are formed at desired locations using lithographical techniques that involve process steps including, for example, a photoresist material (e.g., a dry film resist (DFR) lamination), exposure and development of via openings, plating in the openings to create via connections, and stripping of the photoresist (e.g., stripping the DFR) post plating.

High-permeability magnetic dielectric-films are then sputtered or otherwise formed on the inductor features and vias as shown and described with reference to FIGS. 1A to 1L, below. In various embodiments, the high-permeability magnetic-dielectric films can be created by a multi-layering approach. For example, a layer of one or more thin dielectric materials (e.g., having a thickness of about 1 nm to about 20 nm), such as aluminum oxide ($Al_2O_3$), silicon dioxide ($SiO_2$), or other dielectric film types are first formed (e.g., deposited or sputtered). The formation of the dielectric material is followed by the deposition (or other type of formation) of a thin, magnetic material (e.g., having a thickness of about 0.5 nm to about 5 nm), such as, for example, a cobalt-iron (CoFe) alloy, a nickel-iron (NiFe) alloy, or other types of magnetic material known in the art. In various embodiments, the deposition of the magnetic film is adjusted such that the layer growth is stopped after an initial island formation of nanoparticles of one or more magnetic materials but before coalescence that forms a continuous film. The formation of islands is uniquely possible with sputtering techniques discussed herein. Further, the skilled artisan will recognize that the term "layer" can include a collection of islands that are substantially separated from one another but are still substantially within a same plane. A continuous film may become ferromagnetic or cause conducting paths within the dielectric materials. In a specific exemplary embodiment, the nanoparticles have diameters in a range of about 0.5 nm to about 1.5 nm; the nanoparticles are substantially spherical in shape and are substantially uniformly dispersed within the layer due to forming the dielectric-film layer using a sputtering technique. In various embodiments, the magnetic material may be formed to a thickness of about 20 nm to about 50 nm. In a specific exemplary embodiment, the magnetic material (e.g., the CoFe alloy material) may alternately be deposited with a dielectric material (e.g., an oxide such as $Al_2O_3$) forming multiple planes of magnetic nanoparticles separated by thin dielectric layers in a multi-layer structure.

In a specific exemplary, embodiment, at an optimum thickness of the magnetic material, the magnetic nanoparticles exhibit a superparamagnetic behavior ideal for the various application discussed: a high permeability and reduced or no remanence or coercivity. Permeabilities of up to about ten-times those exhibited by the magnetic-filler-embedded organic dielectric epoxy laminate films have been demonstrated using the techniques of the disclosed subject matter. The permeability can be enhanced further using other magnetic material and dielectric combinations. For example, a CoFe magnetic material can be embedded in an alternate dielectric material such as a nitride instead of oxide (AlN/SiN). This material combination will prevent oxidation of CoFe ($CoFeO_x$ is paramagnetic) and results in a higher permeability of the multi-layer film.

In other embodiments, a layer of $AlO_x/AlN_x/CoFe/AlN_x/AlO_x$ may be used. Also, in various embodiments, alloys that may be less prone to oxidation and have higher surface energies, which will prevent wetting of magnetic particles by the dielectric and, accordingly, provide much larger saturation magnetization before coalescing into a film, can be used such as, for example, CoFe (Zr, B, Ta), and so on.

Continuing with the process flow, standard build-up dielectric films are then laminated and subsequently planarized/ground to expose the underlying via. A Ti—Cu seed layer is then sputtered and a traditional semi-additive process (SAP) may then be used to build as many redistribution layers (RDLs) as desired for a given application. RDLs can be used to relocate signals from contact pads or other types of input/output (I/O) contacts to other physical locations. RDLs are known in the art.

As disclosed herein, since the magnetic-dielectric films do not come in contact with any of the substrate manufacturing wet chemistries, there is little to no risk of contamination in wet plating and etch tools, such as, for example, de-smear, electroless-copper seed, seed etching, and copper-roughening baths. The panel separation and subsequent back-end processes may be similar to various substrate manufacturing-processes. If complete encapsulation of the inductor features is desired, magnetic paste may be stencil printed in openings as shown post surface-finish prior to front-side interconnect (e.g., micro-ball) formation. In this case, the openings where magnetic paste is to be stencil printed may be covered by a protective film, such as DFR, during surface finish and subsequent interconnect-formation processes.

FIGS. 1A-1L show various cross-sectional views of an exemplary process flow to create embedded inductors in coreless-substrate fabrication according to various embodiments of the disclosed subject matter.

In particular, and referring now to the exemplary embodiment of FIG. 1A, a substrate 101 has a release layer 103, a seed layer 105, and a number of conductive regions 107 formed on the seed layer 105.

The substrate 101 may be one of various types of substrate or carrier material known in the art. For example, the substrate may comprise glass, various types of metal, elemental semiconductors, compound semiconductors, prepreg materials, and other types of substrate known in the art. In embodiments, the substrate 101 can be a releasable panel, a peel-able core substrate, or another type of build-up carrier known in the art.

The release layer 103 can comprise various types of material layers known in the art that allow for later release of fabricated features from the substrate 101. The release layer 103 may be used to separate one or more layers from a wafer or other substrate. The release can be accomplished by various types of release systems such as, for example, thermal release, chemical release, mechanical release, and laser release. Each of these release systems is known in the art.

The seed layer 105 may be sputtered or otherwise formed over the release layer 103 and comprises, for example, copper (Cu), titanium (Ti), or titanium-copper (Ti—Cu). Using titanium as at least a portion of the seed layer 105 allows the seed layer 105 to serve both as an adhesion-promoting layer and a barrier layer to Cu diffusion.

In one embodiment, the conductive regions 107 may comprise copper or other conductive materials known in the art. The conductive regions 107 may comprise one or more of the conductive materials described herein, other types of metals, or a combination of materials. Conductive materials may include, but are not limited to, metals and their alloys used in standard semiconductor fabrication processes such as aluminum (Al), copper (Cu), and their alloys.

The conductive regions 107 are first formed by plating a layer (e.g., a conductive layer) in the openings that are created lithographically over the seed layer 105. A photoresist material is first coated, if it is a liquid, or laminated, if it is a dry-film resist (DFR) film, over the seed layer 105, which is subsequently exposed (e.g., lithographically exposed), developed, and etched to form individual openings in which the conductive regions 107 are formed as shown. The conductive regions can be formed by electrolytic copper deposition process. As described in more detail below, the conductive regions 107 can serve as conductive pads to connect to a circuit and/or conductive traces to carry current between various portions of the device.

Figure 1B:
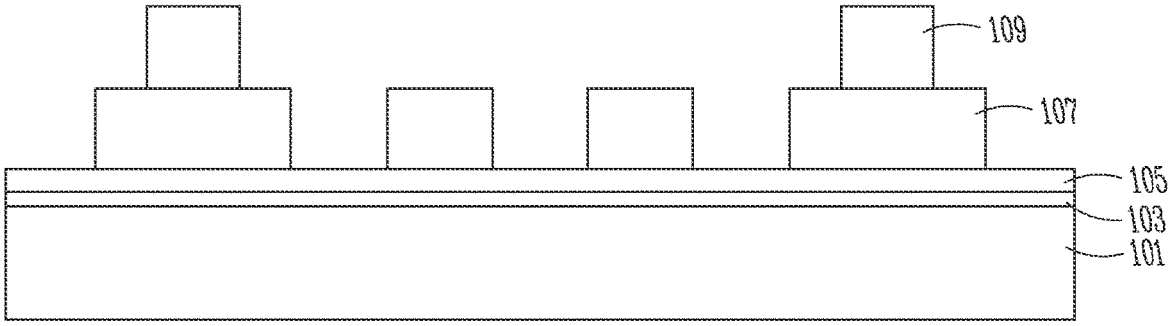

FIG. 1B is shown to include a number of conductive pillars 109 that are, for example, formed and lithographically defined openings over at least a portion of the conductive regions 107. The conductive pillars 109 may comprise copper or any of various conductive materials known in the art as well as those described herein. The conductive pillars 109 are later formed into conductive vias as described below with regard to FIG. 1E.

Figure 1C:
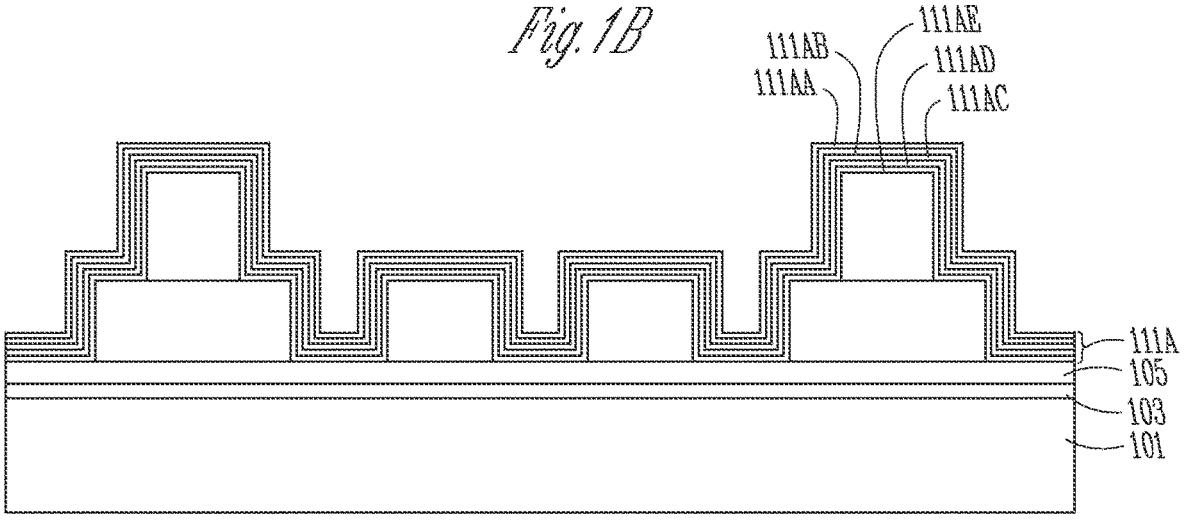

In FIG. 1C, a magnetic-dielectric film 111A is formed over exposed portions of the conductive pillars 109 and the conductive regions 107. The magnetic-dielectric film 111A as above, may be formed from a plurality of thin dielectric layers 111AA, 111AB, 111AE between each of which a plurality of magnetic material layers 111AB, 111AD is disposed. The magnetic-dielectric film 111A may be about 0.1 micron to about 10 microns in thickness. Upon reading and understanding the disclosure provided herein, the skilled artisan will recognize how to determine the thickness desired for a given application based at least partially on a permeability of the magnetic-dielectric film 111A.

Figure 1D:
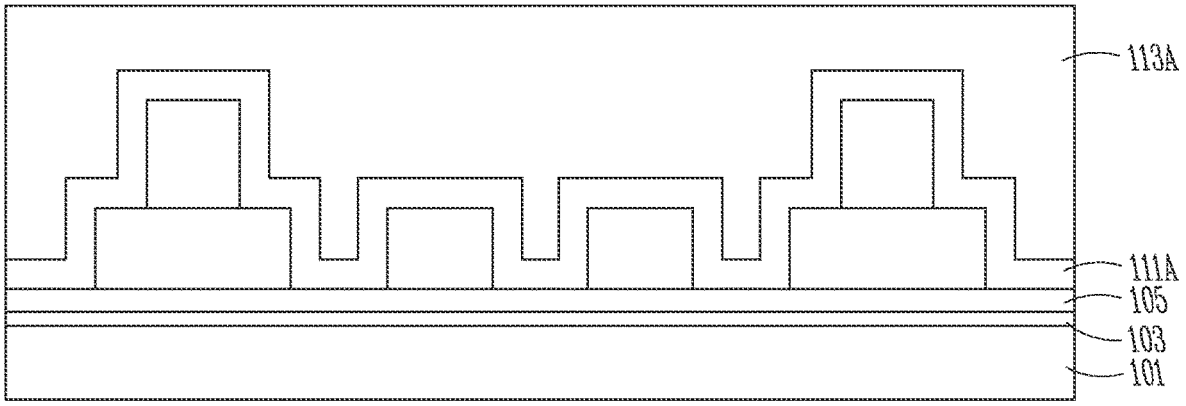

In FIG. 1D, a dielectric-film layer 113A, such as those used in standard organic High Density Interconnect (HDI) build-up layer formation, is formed over the magnetic-dielectric film 111A. The dielectric-film layer 113A may comprise one or more materials such as, for example, Ajinomoto Build-up Films (ABF, available from Ajinomoto Kabushiki-gaisha, Chuo, Tokyo, Japan) or similar materials known in the art.

Figure 1E:
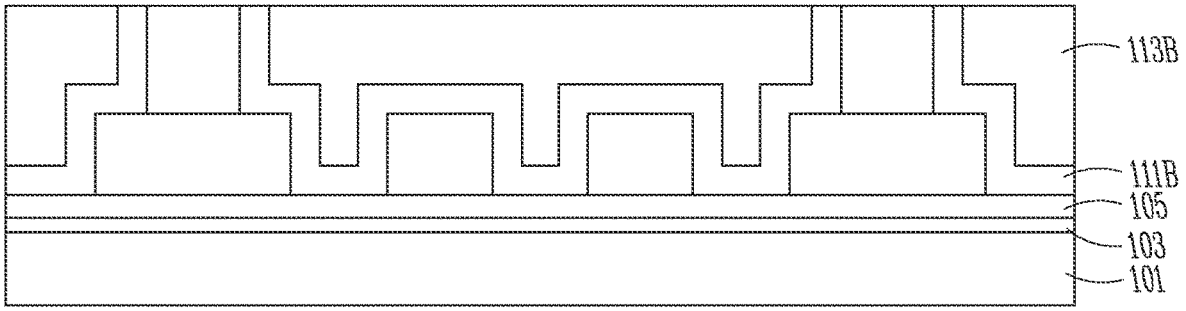

Referring now to FIG. 1E, uppermost portions of the dielectric-film layer 113A and the magnetic-dielectric film 111A are removed to expose the underlying ones of the conductive pillars 109 of FIG. 1B, which will later serve as conductive vias as described in more detail below. In various embodiments, the uppermost portions of the dielectric-film layer 113A and the magnetic-dielectric film 111A may be removed by processes known in the art, such as chemical-mechanical planarization (CMP) or various types of grinding techniques. With continuing reference to FIG. 1E, after the CMP or grinding operation is completed, a reduced-thickness dielectric-film layer 113B and opened-portions 111B of the magnetic-dielectric film 111A remain.

Figure 1F:
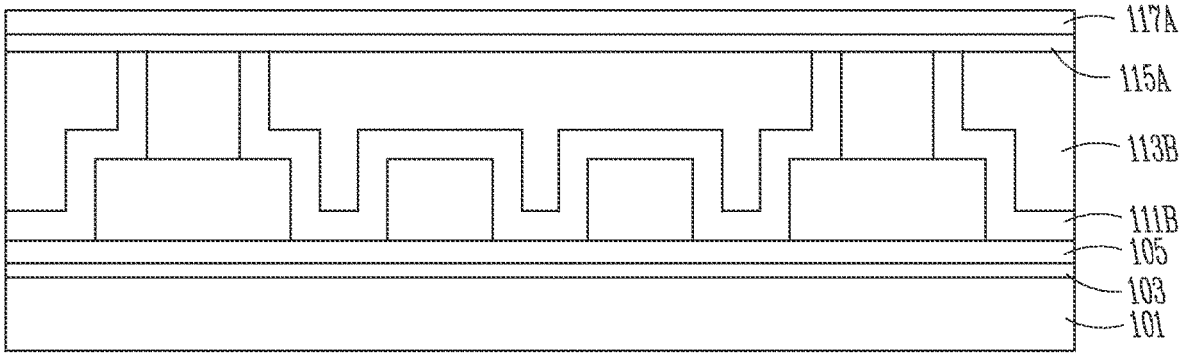

In FIG. 1F, a dry-seed layer is formed over reduced-thickness dielectric-film layer 113B and the opened-portions 111B of the magnetic-dielectric film 111A. In various embodiments, the dry-seed layer may comprise a titanium (Ti) layer 115A and a copper (Cu)-seed layer 117A. Either or both of these layers may be sputtered or otherwise formed by techniques known in the art. In an embodiment, the Ti layer 115A serves as an adhesion layer. However, in embodiments, the Cu-seed layer 117A may otherwise be formed directly over reduced-thickness dielectric-film layer 113B and the opened-portions 111B of the magnetic-dielectric film 111A.

Figure 1G:
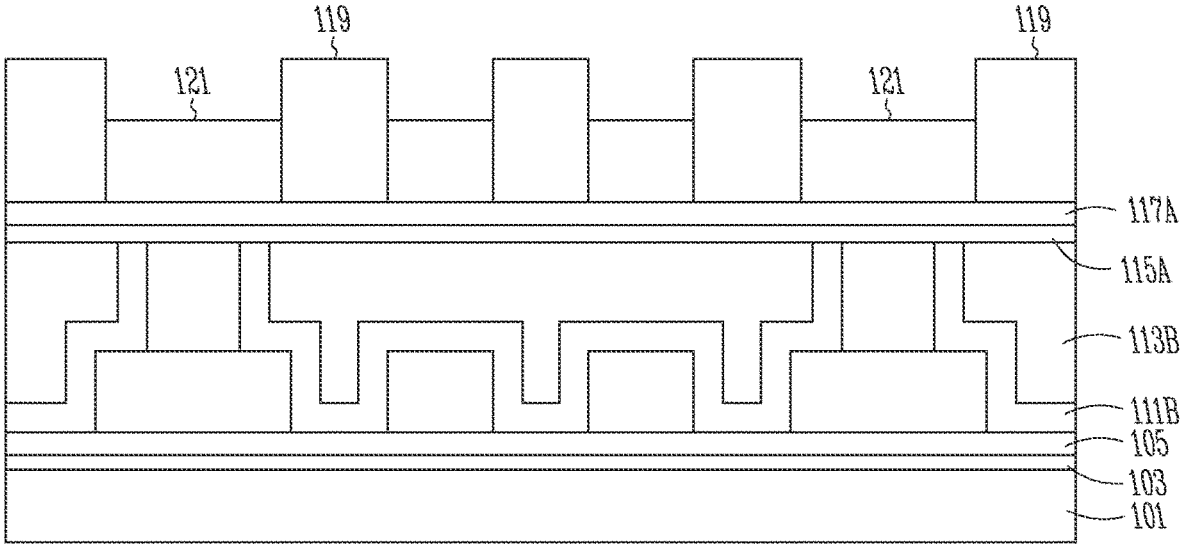

FIG. 1G shows a second-level set of conductive regions 121 that are formed in apertures (openings) that are formed within, for example, a resist layer 119 coating or film. In various embodiments, the resist layer 119 may comprise a DFR film. The second-level set of conductive regions 121 are formed over portions of the Ti layer 115A and the Cu-seed layer 117A that overlay the vias that were formed from the conductive pillars 109 (see FIG. 1B). The second-level set of conductive regions 121 may comprise copper or any of various conductive materials known in the art including those described herein. Therefore, the second-level set of conductive regions 121 may be formed of material the same as, or similar to, the material used to form the conductive regions 107 of FIG. 1A.

Figure 1H:
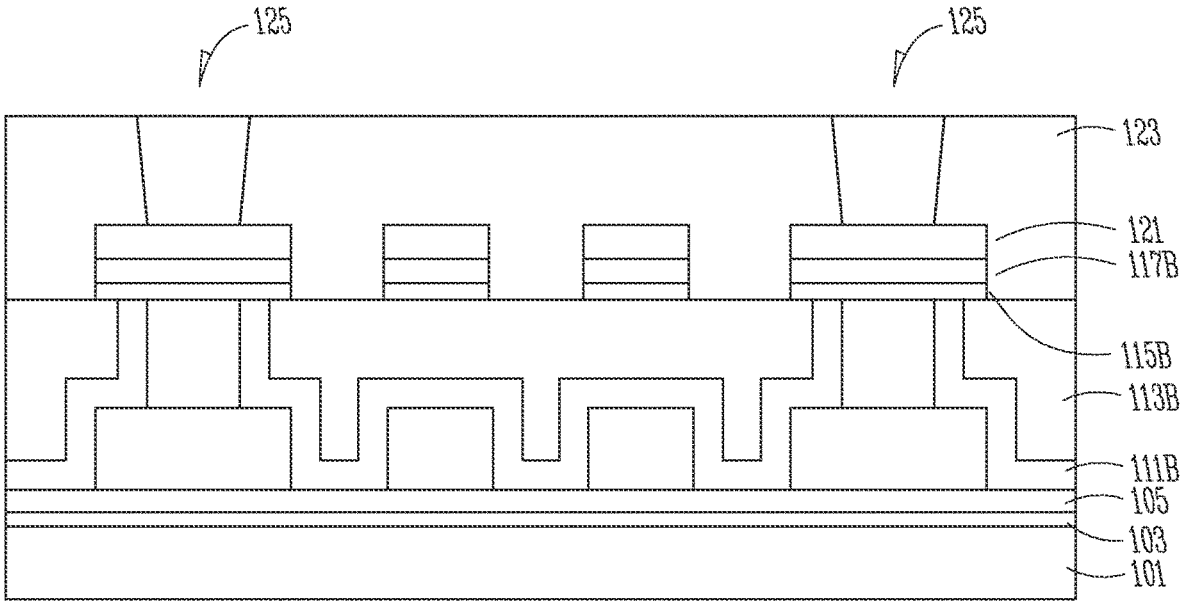
Figure 11:
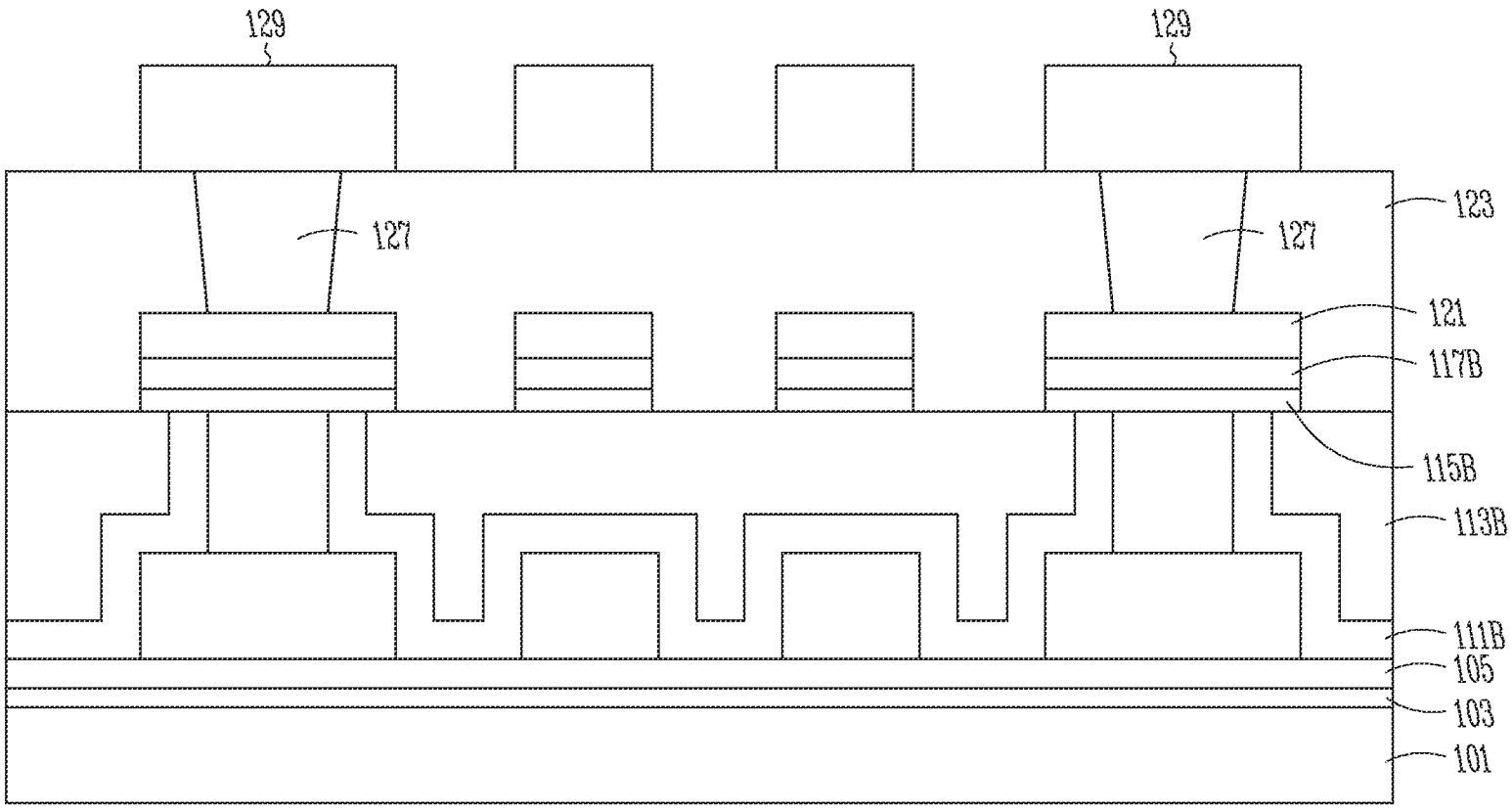

In FIG. 1H, the resist layer 119 is stripped or otherwise removed and a second dielectric-layer 123 is formed over the second-level set of conductive regions 121. As shown in FIG. 1H, portions of the Ti layer 115A and the Cu-seed layer 117A are also removed to provide a patterned Ti layer 115B and patterned Cu-seed layer 117B. The second dielectric-layer 123 may comprise one or more of the dielectric materials discussed above. In one specific exemplary embodiment, the second dielectric-layer 123 may be about 30 microns to about 40 microns in depth. However, this thickness is provided as an example only to better illustrate various embodiments of the disclosed subject matter.

With continuing reference to FIG. 1H, a number of openings 125 are formed in the second dielectric-layer 123 down to at least an uppermost portion of at least some of the second-level set of conductive regions 121. In some embodiments, the openings 125 may be formed by various techniques known in the industry such as laser drilling, an anisotropic dry etch process (e.g., reactive ion etch (RIE) or plasma etch), or a wet-etch process. In other embodiments, depending upon materials selected, the openings 125 may be formed by one or more various types of chemical etchants, mechanical techniques, other types of ion milling, or laser ablation techniques. In a specific exemplary embodiment, the openings are formed to have an approximate circular cross-section with a diameter of about 45 microns to about 50 microns. In other embodiments, the openings may not have an approximately circular cross-section and may be ellipsoidal, rectangular, or have a number of other cross-sectional shapes. In the case of non-circular cross-sections, the cross-sections may be defined by a characteristic dimension, such as a major and a minor diameter. Upon reading and understanding the disclosure provided herein, the skilled artisan will recognize how to select both an appropriate thickness of the second dielectric-layer 123, as well as a shape, and a diameter or other characteristic dimension of the openings 125 for a given application.

Subsequent to forming the openings 125, the openings 125 may be cleaned with, for example, one or more various types of wet processes known in the art. With continuing reference to FIG. 1H, the skilled artisan will recognize and appreciate that the opened-portions 111B of the magnetic-dielectric film 111A are never exposed to any chemicals used to etch or clean the openings 125.

Referring now to FIG. 1I, the openings 125 of FIG. 1H are filled with a conductive material 127. The conductive material 127 may comprise one or more of the conductive materials described herein, other types of metals, or a combination of materials described herein and known in the art. Conductive materials may include, but are not limited to, metals or their alloys used in standard semiconductor fabrication processes such as aluminum (Al), copper (Cu), and their respective alloys.

Further, although not shown explicitly in FIG. 1I, the skilled artisan will recognize that an additional magnetic-dielectric film may be formed around at least the conductive regions 121 and the conductive material 127 with slight variations to the fabrication processes described above.

Additionally, another level of conductive regions 129 may be formed above the conductive material 127. The conductive regions 129 may be formed with or without the dry seed-layer described above. In various embodiments, many of the above-described fabrication steps may be repeated as many times as desired for a given application.

Figure 1J:
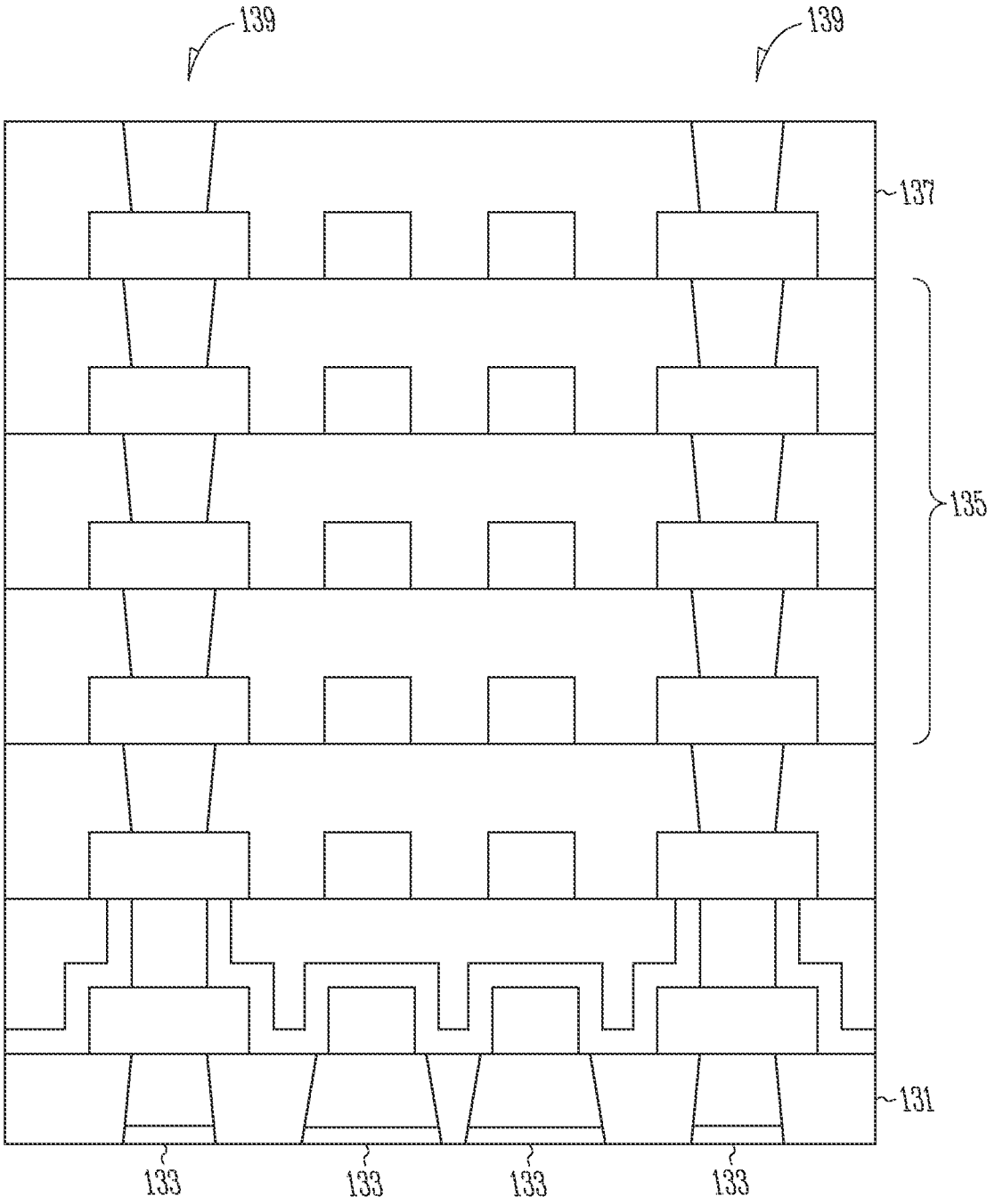

For example, with reference now to FIG. 1J, a cross-sectional view of an exemplary process flow to create embedded inductors in a coreless-substrate fabrication is shown to include a number of redistribution (RDL) layers 135 to reroute internal conductive leads as desired for a given application. Formation and usage of the RDL layers are known in the art.

FIG. 1J also shows that the substrate 101, the release layer 103, and the seed layer 105 of FIGS. 1A-1I have now been removed. The substrate 101 and the release layer 103 have been removed or otherwise released by laser, chemical, or mechanical separation technique known in the art. The seed layer 105 is then etched or otherwise removed. A lower resist-layer 131 and an upper resist-layer 137 are then formed or otherwise formed. In one embodiment, the resist layers 131, 137 may comprise a solder-resist layer that is laminated or otherwise formed, followed by exposure and develop to form openings. As shown, openings on the resist layers are then formed (e.g., openings 139 on the upper resist-layer 137). Portions of the openings on the lower resist-layer 131 are either formed during a subsequent operation or are covered by various materials 133, known in the art, prior to a determination of where later-applied contacts are to be formed.

Figure 1K:
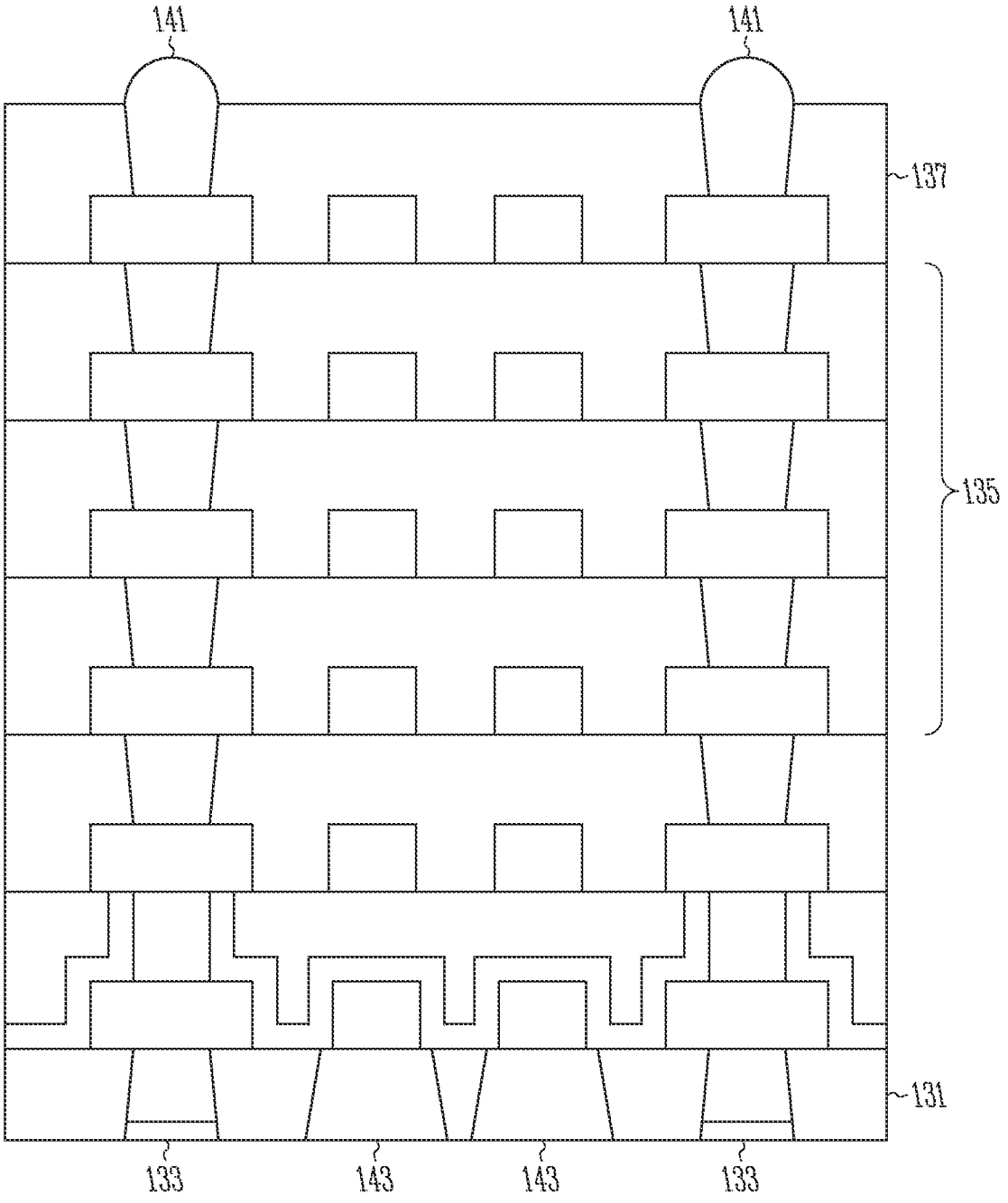

In various embodiments as shown in FIG. 1K, a number of electrical interconnects 141 are formed within the openings 139 (see FIG. 1J) to form electrically-conductive elements within the upper resist-layer 137. The electrical interconnects 141 may comprise any type of electrical-contact point (e.g., an electrical-contact pad) known in the art such as various types of contact pads, solder balls or micro-balls (including controlled-collapse chip-connection (C4)), wire bonds, and others. The electrical contacts may comprise, for example, a suitable electrically-conductive material such as nickel (Ni), palladium (Pd), gold (Au), silver (Ag), copper (Cu), Tin (Sn), and combinations of alloys thereof. In a specific exemplary embodiment, the electrical interconnects 141 comprise a nickel-palladium-gold (Ni—Pd—Au) with Sn or its alloys to form the bump.

Figure 1L:
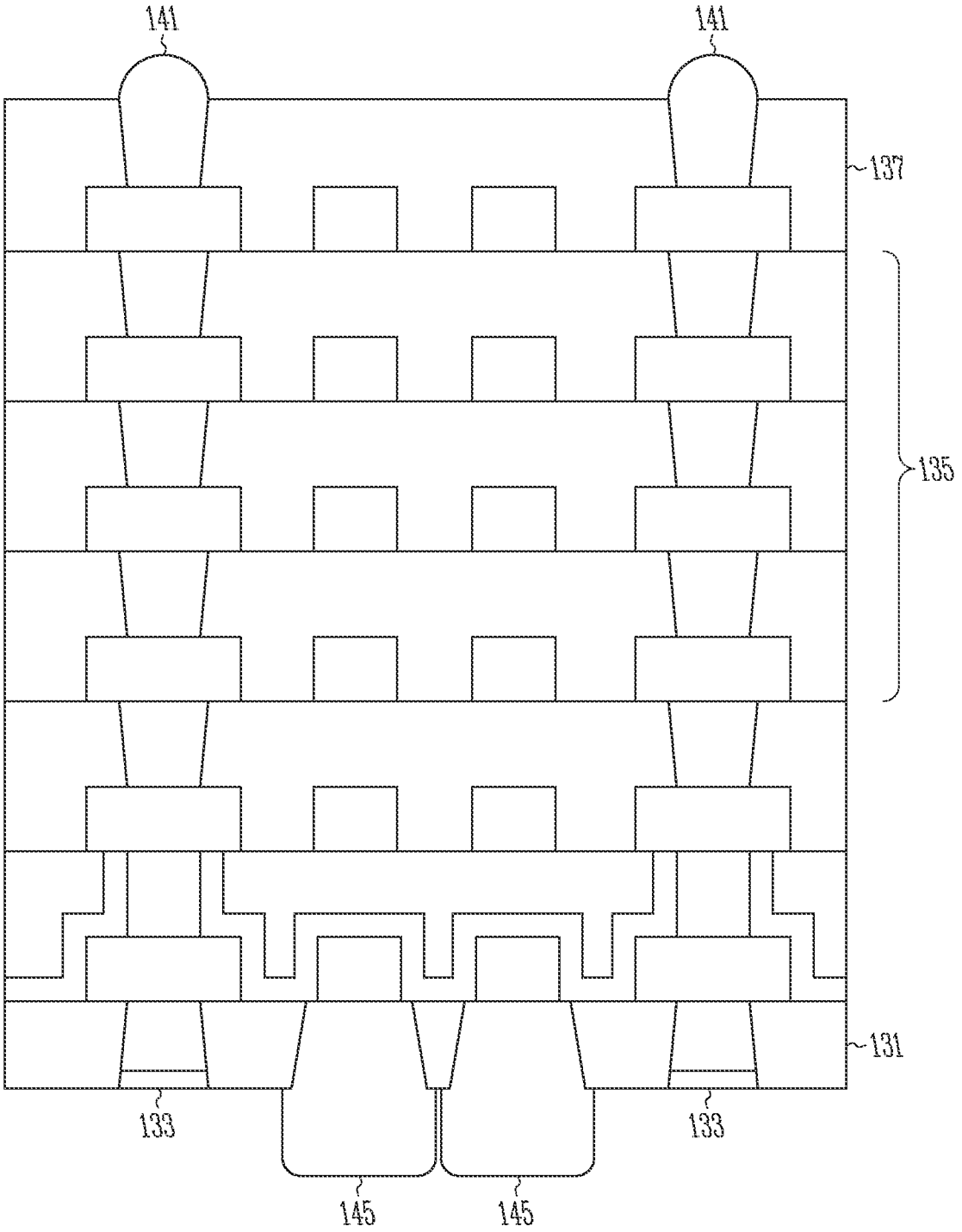

FIG. 1K also shows that a number of openings 143 have been formed in the lower resist-layer 131 by removing at least some of the materials 133 prior to a subsequent formation of lower-level contacts 145 (e.g., electrical interconnects) as shown in FIG. 1L. The lower-level contacts 145 may comprise a magnetic paste that is formed in desired openings.

In various embodiments, a mask layer, not shown but understandable to a skilled artisan, is applied over the resist layers 131, 137 prior to forming the electrical interconnects 141, 145 so as to form the interconnects only in desired areas. For example, a DFR film may be applied to the lower resist-layer 131 prior to applying paste in the openings 143 of FIG. 1K.

Figure 2:
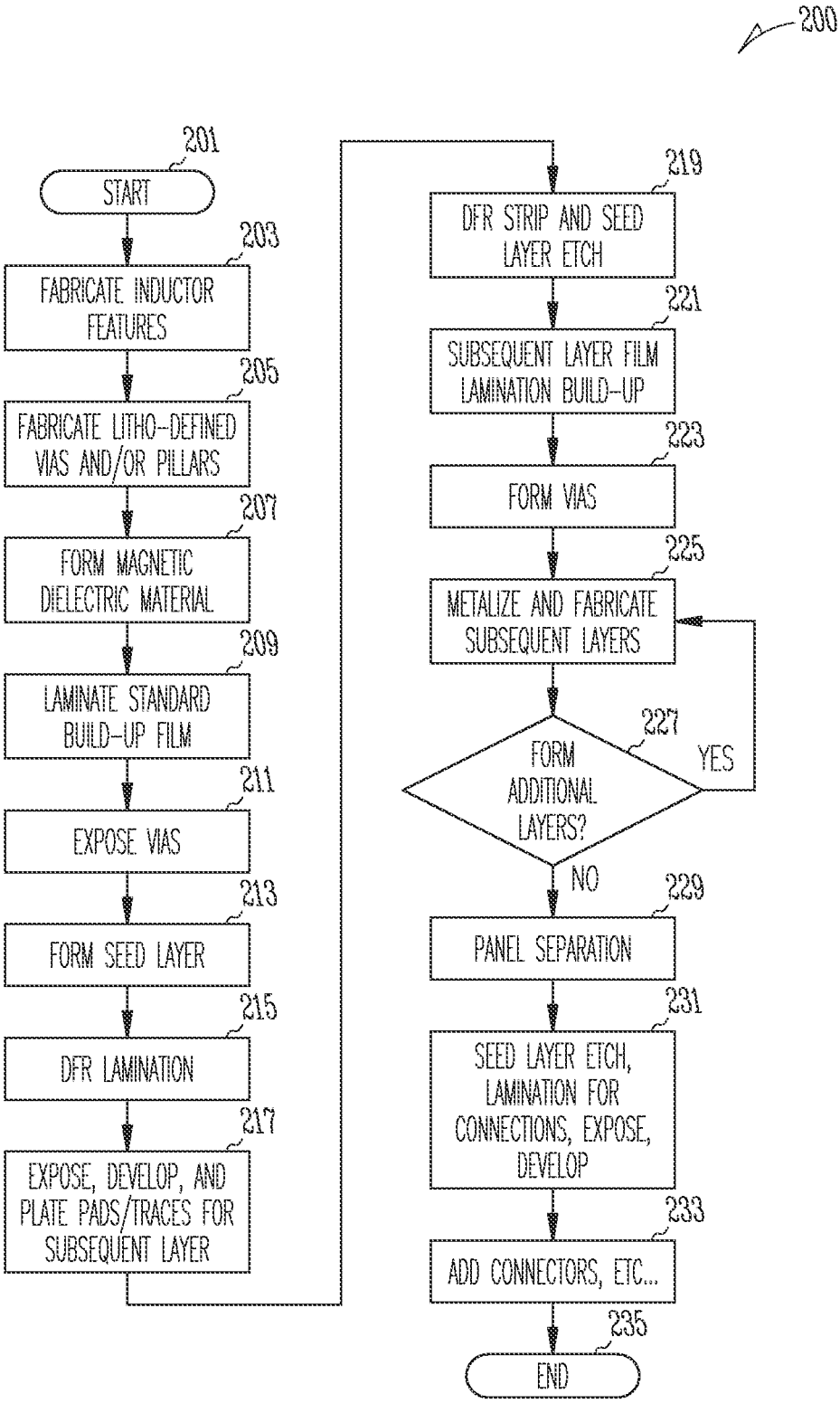
FIG. 2 shows an exemplary method for fabricating embedded inductors in accordance with various embodiments of the disclosed subject matter.

With reference now to FIG. 2, an exemplary method 200 for fabricating embedded inductors in accordance with various embodiments of the disclosed subject matter is shown.

With concurrent reference to FIGS. 1A-1L, the exemplary method 200 begins at operation 201. Inductor features are fabricated at operation 203 (see also FIG. 1A and accompanying descriptions). Lithographically-defined vias and/or conductive pillars are fabricated at operation 205 (see also FIG. 1B and accompanying descriptions). A magnetic-material layer is then formed over the vias/pillars and the inductor features at operation 207 (see also FIG. 1C and accompanying descriptions). At operation 209, a build-up film (e.g., a dielectric layer) is laminated or otherwise formed over the magnetic-dielectric material layer (see also FIG. 1D and accompanying descriptions). The vias/conductive pillars are then exposed (e.g., through etching, a CMP process, or a grinding process) at operation 211 (see also FIG. 1E and accompanying descriptions). A seed layer is then formed over the exposed vias/conductive pillars at operation 213 (see also FIG. 1F and accompanying descriptions).

With concurrent reference now to FIG. 1G and accompanying descriptions, a DFR lamination, or alternatively, a photoresist layer, is then formed over the seed layer at operation 215. At operation 217, the DFR lamination or the photoresist is exposed and developed. Contact pads and/or electrical traces are formed within the developed areas.

Referring concurrently to FIG. 1H and the accompanying descriptions, the photoresist or DFR lamination is stripped or otherwise removed and the seed layer is etched at operation 219. At operation 221, a subsequent film layer is formed (e.g., a dielectric film is deposited) and vias are then formed through the subsequent film layer.

Metallization occurs to form a conductive region within the vias at operation 225. Additionally, subsequent film layers may be fabricated, including forming additional conductive features (see also FIG. 1I and accompanying descriptions).

At operation 227, a determination is made as to whether additional layers (e.g., redistribution layers) should be formed for a given application. The skilled artisan, upon reading and understanding the disclosure provided herein, will recognize when such additional layers are to be formed. If a determination is made that additional layers are to be formed, the exemplary method 200 continues back to operation 225. If a determination is made that no additional layers are to be formed, the exemplary method 200 continues to operation 229.

At operation 229, panel separation occurs, followed by a subsequent seed layer etch, including forming a lamination and exposing and developing at operation 231 to add electrical connections (e.g., micro-balls) at operation 233 (see also FIGS. 1J-1L and accompanying descriptions). The exemplary method ends at operation 235.

Figure 3:
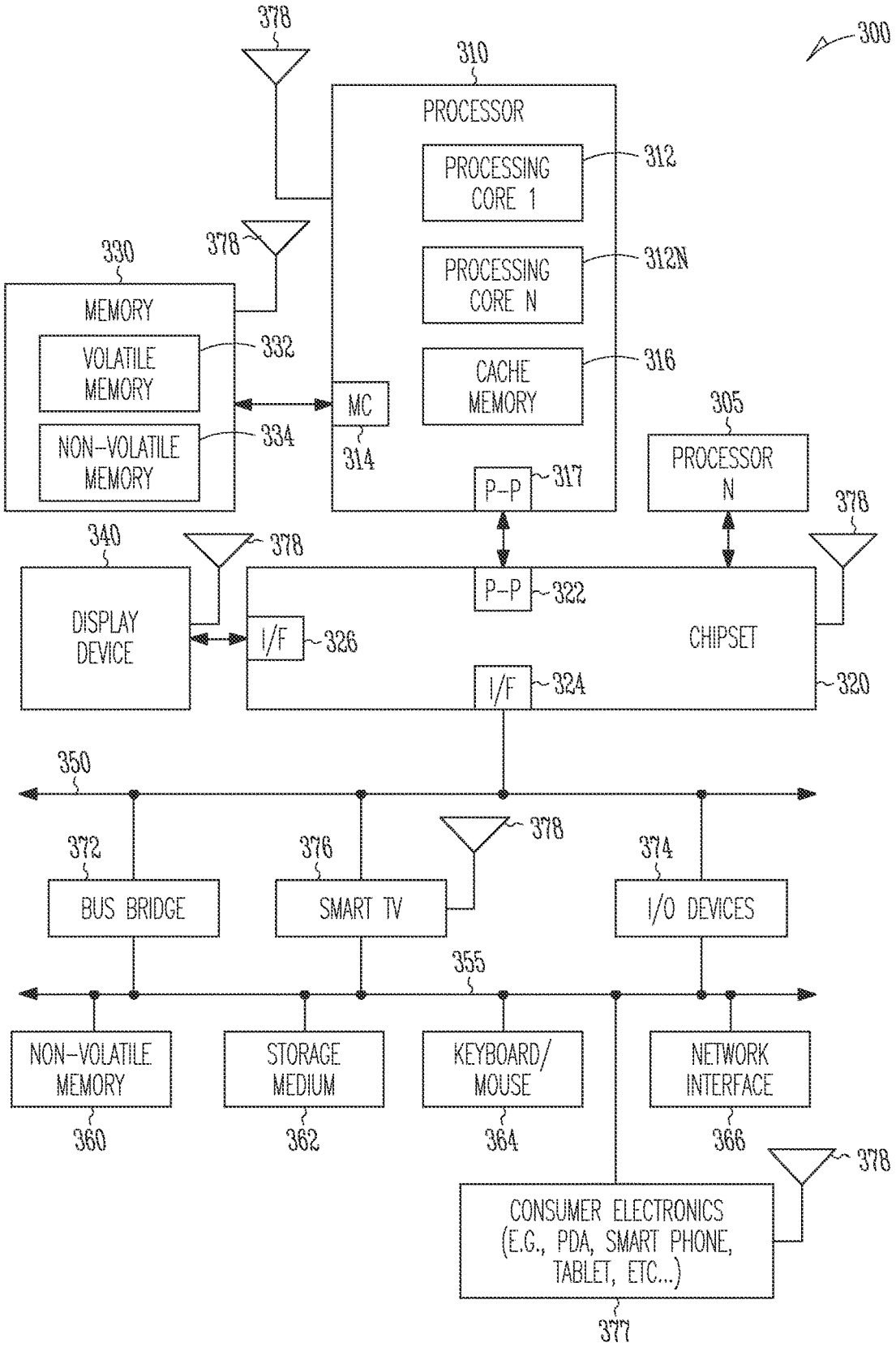
FIG. 3 shows a system-level diagram which may incorporate an electronics package including an embedded inductor in accordance with various exemplary embodiments disclosed herein.

FIG. 3 illustrates a system-level diagram, depicting an example of an electronic device (e.g., a system) including the high-permeability magnetic-dielectric film-based inductor as described herein in the present disclosure. FIG. 3 is shown to include an example of a higher-level device application for the high-permeability magnetic-dielectric film-based inductor. In one embodiment, a system 300 includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance, or any other type of computing device. In some embodiments, the system 300 is a system-on-a-chip (SOC).

In one embodiment, a processor 310 has one or more processor cores 312, 312N, where the processor core 312N represents the Nth processor core inside the processor 310, where N is a positive integer. In one embodiment, the system 300 includes multiple processors including the processor 310 and a processor N 305, where the processor N 305 has logic similar or identical to the logic of the processor 310.

In some embodiments, the processor core 312 includes, but is not limited to, pre-fetch logic to fetch instructions, decode logic to decode the instructions, execution logic to execute instructions, and the like. In some embodiments, the processor 310 has a cache memory 316 to cache instructions and/or data for the system 300. The cache memory 316 may be organized into a hierarchal structure including one or more levels of cache memory.

In some embodiments, the processor 310 includes a memory controller 314, which is operable to perform functions that enable the processor 310 to access and communicate with memory 330 that includes a volatile memory 332 and/or a non-volatile memory 334. In some embodiments, the processor 310 is coupled with the memory 330 and a chipset 320. The processor 310 may also be coupled to a wireless antenna 378 to communicate with any device configured to transmit and/or receive wireless signals. In one embodiment, an interface for the wireless antenna 378 operates in accordance with, but is not limited to, the IEEE 802.11 standard and its related family, Home Plug AV (HPAV), Ultra-Wide Band (UWB), Bluetooth®, WiMax®, or any form of wireless communication protocol.

In some embodiments, the volatile memory 332 includes, but is not limited to, Synchronous Dynamic Random Access Memory (SDRAM), Dynamic Random Access Memory (DRAM), RAMBUS Dynamic Random Access Memory (RDRAM), or any other type of random access memory device. The non-volatile memory 334 includes, but is not limited to, flash memory, phase change memory (PCM), read-only memory (ROM), electrically erasable programmable read-only memory (EEPROM), or any other type of non-volatile memory device.

The memory 330 stores information and instructions to be executed by the processor 310. In one embodiment, the memory 330 may also store temporary variables or other intermediate information while the processor 310 is executing instructions. In the illustrated embodiment, the chipset 320 connects with the processor 310 via Point-to-Point (PtP or P-P) interfaces 317, 322. The chipset 320 enables the processor 310 to connect to other elements in the system 300. In some embodiments of the example system, the interfaces 317, 322 operate in accordance with a PtP communication protocol such as the Intel® QuickPath Interconnect (QPI) or the like. In other embodiments, a different interconnect may be used.

In some embodiments, the chipset 320 is operable to communicate with one or more of the processors 310, 305, a display device 340, and other devices, including a bus bridge 372, a smart TV 376, I/O devices 374, a nonvolatile memory 360, a storage medium 362 (such as one or more mass storage devices) 362, a keyboard/mouse 364, a network interface 366, and various forms of consumer electronics 377 (such as a PDA, smart phone, tablet, etc.), etc. In one embodiment, the chipset 320 couples with these devices through an interface 324. The chipset 320 may also be coupled to a wireless antenna 378 to communicate with any device configured to transmit and/or receive wireless signals.

The chipset 320 connects to the display device 340 via the interface 326. The display device 340 may be, for example, a liquid crystal display (LCD), a light emitting diode (LED) array, an organic light emitting diode (OLED) array, or any other form of visual display device. In some embodiments of the example system 300, the processor 310 and the chipset 320 are merged into a single SOC. In addition, the chipset 320 connects to one or more buses 350, 355 that interconnect various system elements, such as the I/O devices 374, the nonvolatile memory 360, the storage medium 362, the keyboard/mouse 364, and the network interface 366. The buses 350, 355 may be interconnected together via the bus bridge 372.

In one embodiment, the storage medium 362 includes, but is not limited to, a solid-state drive, a hard disk drive, a universal serial bus flash memory drive, or any other form of computer data storage medium. In one embodiment, the network interface 366 is implemented by any type of well-known network interface standard including, but not limited to, an Ethernet interface, a universal serial bus (USB) interface, a Peripheral Component Interconnect (PCI) Express interface, a wireless interface and/or any other suitable type of interface. In one embodiment, the wireless interface operates in accordance with, but is not limited to, the IEEE 802.11 standard and its related family, Home Plug AV (HPAV), Ultra-Wide Band (UWB), Bluetooth, WiMax, or any form of wireless communication protocol.

While the modules shown in FIG. 3 are depicted as separate blocks within the system 300, the functions performed by some of these blocks may be integrated within a single semiconductor circuit or may be implemented using two or more separate integrated circuits. For example, although the cache memory 316 is depicted as a separate block within the processor 310, the cache memory 316 (or selected aspects of the cache memory 316) can be incorporated into the processor core 312.

As noted above, various embodiments of the high-permeability magnetic-dielectric film-based inductor described herein may be implemented with one or more of the devices of the system 300. The magnetic-dielectric film-based inductors are described with reference to forming one or more components within the system 300. However, the person of ordinary skill in the art will recognize, upon reading and understanding the disclosure provided herein, that one or more of the various embodiments can be used in any situation calling for a magnetic-dielectric film-based inductor.

Therefore, the description above includes illustrative examples, devices, systems, and methods that embody the disclosed subject matter. In the description, for purposes of explanation, numerous specific details were set forth in order to provide an understanding of various embodiments of the disclosed subject matter. It will be evident, however, to those of ordinary skill in the art that various embodiments of the subject matter may be practiced without these specific details. Further, well-known structures, materials, and techniques have not been shown in detail, so as not to obscure the various illustrated embodiments.

As used herein, the term "or" may be construed in an inclusive or exclusive sense. Further, other embodiments will be understood by a person of ordinary skill in the art upon reading and understanding the disclosure provided. Further, upon reading and understanding the disclosure provided herein, the person of ordinary skill in the art will readily understand that various combinations of the techniques and examples provided herein may all be applied in various combinations.

As used herein, the term electrically-conductive elements broadly includes all types of electrical routing features configured to route electrical signals to or from various regions within a device or to regions of external devices (not shown). Thus, the term electrically-conductive elements includes, for example, traces, pads, pillars and/or vias. The electrically-conductive elements therefore includes internal electrical routing features and die-level electrical interconnection and electrical routing features.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

Although various embodiments are discussed separately, these separate embodiments are not intended to be considered as independent techniques or designs. As indicated above, each of the various portions may be inter-related and each may be used separately or in combination with other of the magnetic-dielectric film-based inductor embodiments discussed herein.

Consequently, many modifications and variations can be made, as will be apparent to the person of ordinary skill in the art upon reading and understanding the disclosure provided herein. Functionally equivalent methods and devices within the scope of the disclosure, in addition to those enumerated herein, will be apparent to a skilled artisan from the foregoing descriptions. Portions and features of some embodiments may be included in, or substituted for, those of others. Such modifications and variations are intended to fall within a scope of the appended claims. Therefore, the present disclosure is to be limited only by the terms of the appended claims, along with the full scope of equivalents to which such claims are entitled. It is also to be understood that the terminology used herein is for the purpose of describing particular embodiments only and is not intended to be limiting.

The Abstract of the Disclosure is provided to allow the reader to quickly ascertain the nature of the technical disclosure. The abstract is submitted with the understanding that it will not be used to interpret or limit the claims. In addition, in the foregoing Detailed Description, it may be seen that various features may be grouped together in a single embodiment for the purpose of streamlining the disclosure. This method of disclosure is not to be interpreted as limiting the claims. Thus, the following claims are hereby incorporated into the Detailed Description, with each claim standing on its own as a separate embodiment.

What is claimed is:

1. A magnetic-dielectric film-based inductor, comprising:

a plurality of conductive regions to provide electrical interconnects to the magnetic-dielectric-based inductor from one or more other devices;

a plurality of conductive pillars that are electrically coupled to and formed over at least some of the plurality of conductive regions;

a magnetic-dielectric layer formed over at least some of the plurality of conductive regions and around sidewalls of the plurality of conductive pillars, the magnetic-dielectric layer including:

a plurality of dielectric-material layers; and a plurality of magnetic-material layers, each of the plurality of magnetic-material layers being disposed between adjacent dielectric-material layers of the plurality of dielectric-material layers;

a dielectric film disposed on the magnetic-dielectric layer;

a multi-laver structure comprising:

an adhesion layer disposed on the top surface of each of the plurality of conductive pillars and portions of the dielectric film adjacent to the conductive pillars;

a seed layer disposed on the adhesion layer; and secondary conductive regions disposed on the seed layer; and a secondary dielectric film disposed between sections of the multi-layer structure.

2. The magnetic-dielectric film-based inductor of claim 1, wherein the magnetic-dielectric layer has a permeability greater than about 5.

3. The magnetic-dielectric film-based inductor of claim 1, wherein a thickness of each of the plurality of dielectric-material layers is in a range of about 1 nm to about 20 nm.

4. The magnetic-dielectric film-based inductor of claim 1, wherein a thickness of each of the plurality of magnetic-material layers is in a range of about 0.5 nm to about 5 nm.

5. The magnetic-dielectric film-based inductor of claim 1, wherein a thickness of each of the plurality of magnetic-material layers is in a range of about 20 nm to about 50 nm.

6. The magnetic-dielectric film-based inductor of claim 1, wherein a thickness of the magnetic-dielectric layer is in a range of about 0.1 microns to about 10 microns.

7. The magnetic-dielectric film-based inductor of claim 1, wherein the plurality of dielectric-material layers comprises at least one material selected from materials including aluminum oxide, a nitride, and silicon dioxide.

8. The magnetic-dielectric film-based inductor of claim 1, wherein the plurality of magnetic-material layers comprises at least one material selected from materials including cobalt-iron and nickel-iron and their respective alloys.

9. The magnetic-dielectric film-based inductor of claim 1, wherein the top surface of each of the plurality of conductive pillars remains uncovered by the magnetic-dielectric layer.

10. The magnetic-dielectric film-based inductor of claim 1, further comprising secondary conductive pillars disposed on the multi-layer structure to contact the secondary conductive regions, the secondary dielectric film disposed between the secondary conductive pillars.

11. The magnetic-dielectric film-based inductor of claim 1, wherein the plurality of magnetic-material layers each include islands of nanoparticles of one or more magnetic materials.

12. The magnetic-dielectric film-based inductor of claim 11, wherein the nanoparticles of the one or more magnetic materials are configured to exhibit a superparamagnetic behavior.

13. The magnetic-dielectric film-based inductor of claim 11, wherein the nanoparticles of the one or more magnetic materials have reduced or no remanence and reduced or no coercivity.

14. The magnetic-dielectric film-based inductor of claim 11, wherein the nanoparticles have diameters in a range of about 1 nm to about 10 nm.

15. A magnetic-dielectric-based inductor, comprising:

a plurality of conductive pillars; and a magnetic-dielectric layer formed around sidewalls of the plurality of conductive pillars, the magnetic-dielectric layer including:

a plurality of dielectric-material layers; and a plurality of magnetic-material layers, each of the plurality of magnetic-material layers being disposed between adjacent dielectric-material layers of the plurality of dielectric-material layers;

a dielectric film disposed on the magnetic-dielectric layer;

a multi-laver structure comprising:

an adhesion layer disposed on a top surface of each of the plurality of conductive pillars and portions of the dielectric film adjacent to the conductive pillars;

a seed layer disposed on the adhesion layer; and secondary conductive regions disposed on the seed laver; and a secondary dielectric film disposed between sections of the multi-layer structure.

16. The magnetic-dielectric-based inductor of claim 15, wherein the magnetic-dielectric layer has a permeability greater than about 5.

17. The magnetic-dielectric-based inductor of claim 15, wherein the plurality of magnetic-material layers each do not form a continuous film.

18. The magnetic-dielectric film-based inductor of claim 15, further comprising secondary conductive pillars disposed on the multi-layer structure to contact the secondary conductive regions, the secondary dielectric film disposed between the secondary conductive pillars.

19. The magnetic-dielectric-based inductor of claim 15, wherein the plurality of magnetic-material layers each include islands of nanoparticles of one or more magnetic material s.

20. The magnetic-dielectric-based inductor of claim 19, wherein the nanoparticles of the one or more magnetic materials are configured to exhibit a superparamagnetic behavior.

21. The magnetic-dielectric-based inductor of claim 19, wherein the nanoparticles of the one or more magnetic materials have reduced or no remanence and reduced or no coercivity.

22. The magnetic-dielectric-based inductor of claim 19, wherein the nanoparticles have diameters in a range of about 1 nm to about 10 nm.

23. The magnetic-dielectric-based inductor of claim 19, wherein the nanoparticles are substantially spherical in shape and are substantially uniformly dispersed within the layer.

* * * * *